United States Patent [19]

Edgerton

[11] 4,416,414

[45] Nov. 22, 1983

[54] UTILITY YARD MARKER

[76] Inventor: Allen T. Edgerton, 135 Wilgate Rd., Owings Mills, Md. 21117

[21] Appl. No.: 400,898

[22] Filed: Jul. 22, 1982

[51] Int. Cl.[3] ..... B65D 91/00

[52] U.S. Cl. ..... 232/39; 232/1 C; 232/17; 232/43.4; 232/43.5; 220/8; 40/612

[58] Field of Search ..... 232/39, 38, 17, 1 A, 232/19, 20, 21, 43.4, 43.5, 1 C; 248/152, 146, 147, 149; 40/612, 566, 567; 220/8, 18

[56] References Cited

U.S. PATENT DOCUMENTS

| | | | |
|---|---|---|---|
| 426,660 | 4/1890 | Carroll | 232/39 |
| 438,476 | 10/1890 | Groom | 232/39 |
| 439,631 | 11/1890 | Boynton | 232/39 |
| 736,181 | 8/1903 | Weglein | 232/39 |
| 808,764 | 1/1906 | Larsh | 232/39 |
| 824,126 | 6/1906 | Little | 232/43.5 |
| 968,633 | 8/1910 | Andrews | 220/8 |
| 1,120,955 | 12/1914 | Martin | 220/8 |
| 1,213,792 | 1/1917 | Benner | 220/8 |
| 3,625,370 | 12/1971 | Mintz | 248/149 |

*Primary Examiner*—John J. Wilson
*Attorney, Agent, or Firm*—Walter G. Finch

[57] ABSTRACT

This invention serves several functions in a utility manner. One of the utility functions is to provide a container for receiving mail in an enclosure which is expandable when the mail load is heavy in volume. The other associated utility functions are those normally present in the vicinity of a yard marker. The utility yard marker consists of a frame, an anchoring component, covering over the frame, securing arms for objects, and an enclosed storage area for winter weather products, as well as other associated functions.

9 Claims, 8 Drawing Figures

UTILITY YARD MARKER

BACKGROUND AND SUMMARY OF THE INVENTION

The invention relates to markers and in particular to yard markers. Specifically, it relates a yard marker with facilities for functions performed at and about the vicinity of the marker when it is in use.

Numerous yard markers have been made and used, but usually such markers have been limited to one or two common functions. The most common function being as a resident identification and/or an address, or as a common support for a standard mail box. In some instances such yard markers have incorporated both the function of resident and/or address identification, and the function of a support for a common mail box.

The present invention provides not only for these prior art functions, but also other functions that occur or take place in the vicinity of the marker, but which have no adequate facility provided.

Other functions that occur or take place in the vicinity of a yard marker, and for which the present invention provides a facility, are: the provision of securing means for objects, such as trash and/or garbage containers that have been set out for the trash and/or garbage collector; the provision of a stroage means for winter weather products, such as calcium chloride, large grain salt (where use is permitted by law), and sand or cinders for spreading on icey spots during severe winter weather; the provision of an out-of-the-weather delivery means for a daily or periodic newspaper; and the provision of an expandable mail receiving means.

All of the aforementioned functions occur at, and in the vicinity of, the yard marker, but at present provisions are not provided in the immediate vicinity for such functions. For example: trash and garbage containers are usually set at or near the curb in front of residence for pickup, and animals, such as dogs, upset the containers and spew the contents over the sidewalk and the street, or in windy weather the wind upsets the containers and blows the contents about the neighborhood; in winter weather when icey conditions occur on a sidewalk or steps leading into the house, the products for spreading on the icey spots are usually stored in a basement, garage, or other location which often leads to "letting the job go until later" and then someone falls with serious injury resulting; newspapers are normally tossed on the sidewalk or steps and if rain or snow or other inclement weather occurs before the newspaper is brought in, the newspaper is soaking wet; and in the case of mail delivery, often on a day of a heavy volume of mail the mail box becomes jammed with the mail, tearing some and often resulting in placing some of the mail on top of the box when it will not fit inside.

All of these problems at or in the vicinity of the yard marker are overcome by the present invention. The trash and garbage containers can be easily secured to the yard marker to keep them upright. The winter weather products are immediately available in the storage means of the yard marker to spread upon the icey spots. A special enclosure on the yard marker is provided where newspapers may be delivered out of the inclement weather and retrieved in a dry condtion. The unique and novel easily expandable mail box provides for the extra mail so that the mail is not torn or left on the outside of the box. All of these associated activities which occur at or in the immediate vicinity of the yard marker create the utility function of the present invention.

It is, therefore, an object of this invention to provide a device to serve as a yard marker which has a utility function of a plurality of capabilities.

It is another object of this invention to provide a yard marker to which objects may be secured.

It is also an object of this invention to provide a yard marker within which products can be stored for use at or in the vicinity of the yard marker.

It is yet another object of this invention to provide a yard marker in which items of delivery may be placed for protection from inclement weather conditions.

It is still another object of this invention to provide a yard marker having an expandable mail receiving means as a component thereof.

It is yet still another object of this invention to provide a yard marker that provides a resident identification.

Further objects and advantages of the invention will become more apparent in light of the following description of the preferred embodiments.

DESCRIPTION OF THE PREFERRED EMBODIMENTS

Figure 1:
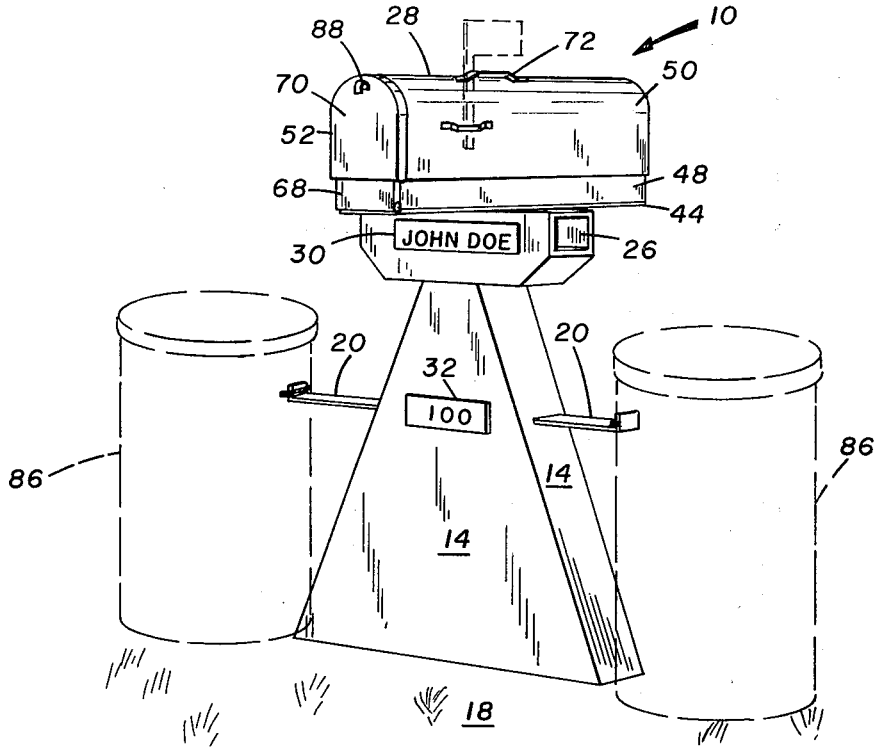
FIG. 1 is a pictorial view of a utility yard marker having a plurality of utility functions.
Figure 2:
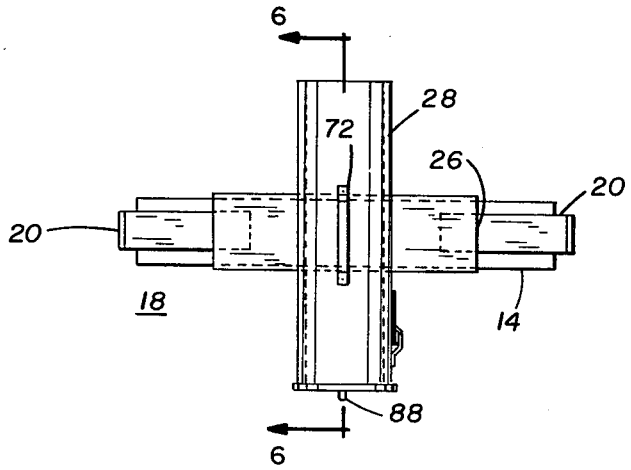
FIG. 2 is a top view of a utility yard marker.

Referring now to the drawings and particularly to FIG. 1, an improved utility yard marker is shown at 10. Several utility functions of the utility yard marker 10 are shown in FIG. 1 and are described hereinafter.

Figure 3:
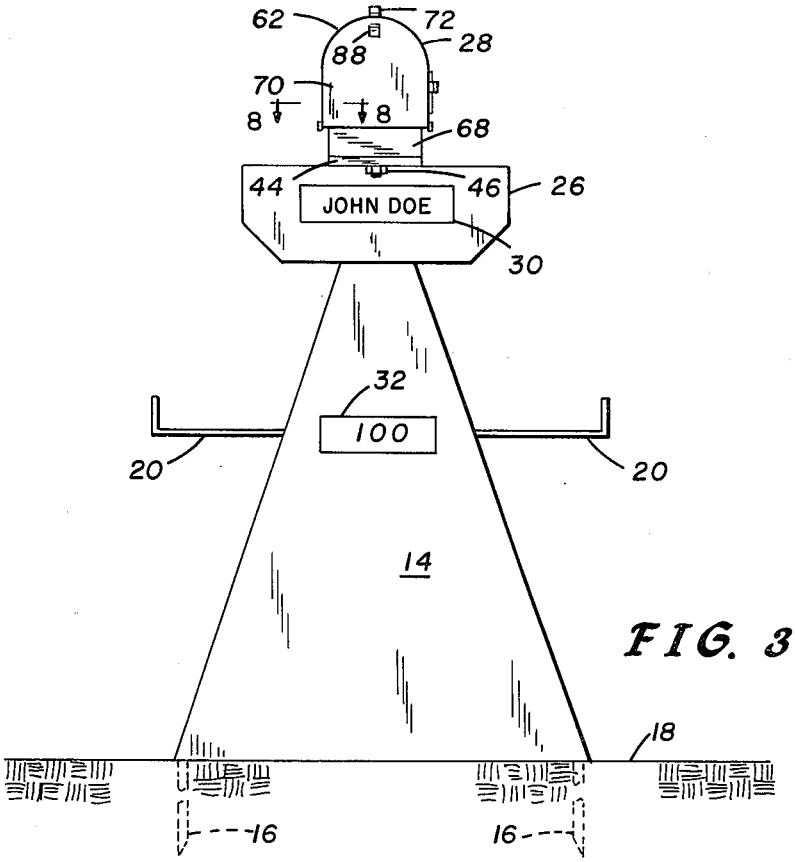
FIG. 3 is a front view of the utility yard marker of FIG. 2.
Figure 4:
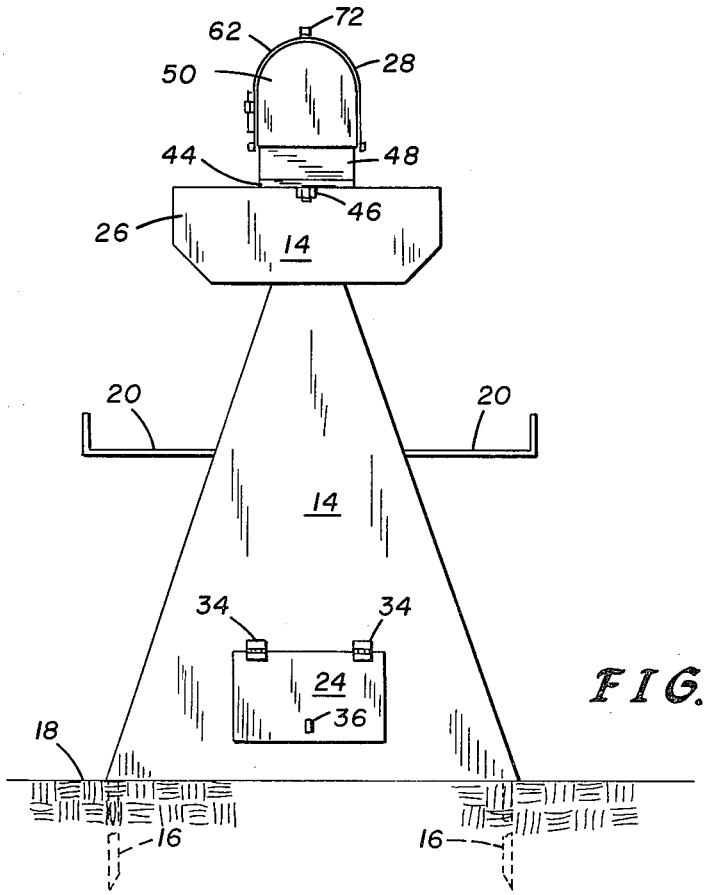
FIG. 4 is a rear view of the utility yard marker of FIG. 3.
Figure 5:
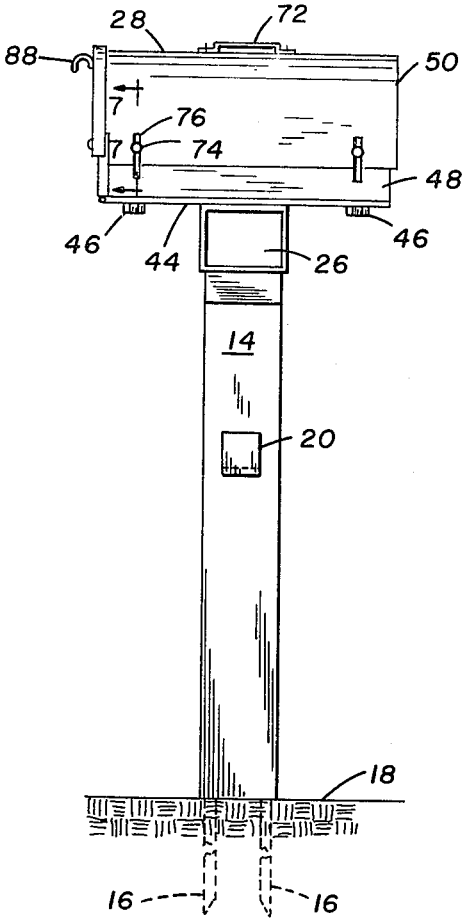
FIG. 5 is an end view of the utility yard marker of FIG. 3.
Figure 6:
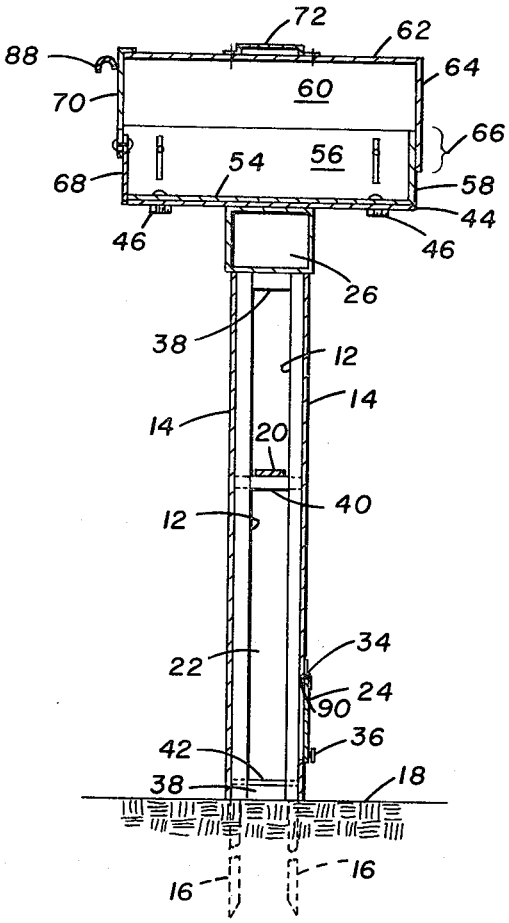
FIG. 6 is a cross-sectional view on line 6—6 of FIG. 2.

The utility yard marker 10 with a structure to accommodate various utility functions performed at or in the vicinity of the yard marker consists of: a frame structure 12 shown in FIG. 6; a covering means 14 shown in FIGS. 1, 2, 3, 4, 5, and 6; an anchoring means 16, as part of or affixed to frame structure 12, shown in FIGS. 3, 4, 5, and 6; hook means 20 for securing objects, such as trash or garbage containers 86; an internal storage area 22, shown in FIG. 6, for storage of winter weather items, such as sand, large grain salt, and calcium chloride; a newspaper, or receiving delivery compartment 26, within the upper frame-work 12, shown in FIGS. 1, 3, 4, 5, and 6, to protect newspapers or other delivered materials from inclement weather; an expandable mail box 28 shown in FIGS. 1 through 6, capable of being expanded for delivery of larger volumes of mail than normal; a resident identification means 30, shown in FIGS. 1 and 3; and a residence locator means 32, shown in FIGS. 1 and 3. Thus, the yard marker of this invention is a utility yard marker. The aforementioned features are described in detail hereinafter.

The frame structure 12 may be made of metal or wood for strength, however, use may also be made of structural type plastics. The frame structure 12, shown in cross-section in FIG. 6, is configured to match the configuration of the utility yard marker and fabricated as is known in the art. Cross braces 38 tie the main portions of the frame structure 12 together. Coupled with the frame structure 12 are special cross braces 40 to which the hook means 20 on each side of the yard marker 10 are affixed. Extensions of the frame structure 12 may be made to provide the anchoring means 16 to the ground or the anchoring means 16 may be separate elements, such as metal spikes or anchor bolts suitably affixed to the frame structure 12. Such anchoring means 16 may be driven into the ground 18 or set in concrete (not shown), depending upon the stability needed for the utility yard marker 10.

The covering 14 may be metal, plastics, plywood, or other similar and suitable materials. Note in FIGS. 1 through 6 that the covering 14 covers the entire outside configuration of the frame structure 12, as well as the exterior of the receiving or newspaper delivery compartment 26. At least one end of the newspaper delivery compartment 26 is left uncovered for depositing items, such as the newspaper. It is to be understood, however, that use of a hinged cover on the open end or ends of the newspaper delivery compartment, or permanently closing the ends to omit provisions for newspaper delivery are within the scope and intent of this invention. The covering 14 is suitably affixed to the frame structure 12.

The hook means 20, of metal or other suitable material is shown with a simple 90° bend to accommodate the objects being secured thereto. However, it is to be understood that it is within the scope and intent of the invention that the hook means 20 may be bent into a loop or eye, or provided with an aperture in the body of the hook means 20, through which a chain may be passed or to which an object may be padlocked if that be desirable to further secure the objects to be held in place.

The internal storage area 22 provides storage space for winter weather materials as described hereinbefore. Such materials may be in bags, cans, small buckets and similar containers. The materials are placed in the storage area 22 through the aperture 90 in covering 14 on the rear side of the utility yard marker 10. The aperture 90 is suitably covered and closed by an access door 24, hinged on one side with spring-loaded hinges 34 to keep it closed tightly. A knob means 36 provides an easy means for opening the access door 24.

If it is not desired to affix the utility yard marker 10 to the ground 18, or for a temporary installation, the storage area 22 may be loaded with heavy weighted materials to fix the utility yard marker 10 in its position without the use of anchoring means 16. It is to be understood that it is within the scope and intent of the invention to include a suitable latch means on the access door 24 or a suitable means for locking the access door 24. A prop or suitable bracket means (not shown) may be used to hold the access door 24 in an open position to put supplies into or take supplies out of the internal storage compartment 22. A floor 42 within the internal storage compartment 22 keeps the stored supplies above the ground 18 level.

The expandable mail box 28 is mounted, as part of the utility yard marker 10, by affixing it to the support plate 44 with suitable fastening means 46. The fastening means 46 pass through the bottom 54 of the lower portion 48 of the mail box 28 and through the support plate 44. The support plate 48 is suitably affixed to the exterior of the top of the combined receiving or newspaper delivery compartment 26 and the frame structure 12. It is to be noted that a plurality of mail boxes 28 may be affixed to utility yard marker 10 by adding additional support plates 44. Such a plurality of mail boxes 28 may be desirable where more than one family resides in a residence marked by the utility yard marker 10. Details regarding the expandable mail box 28 are provided hereinafter.

The body or compartment of the expandable mail box 28 component of the yard marker 10 consists primarily of a lower or bottom portion 48, an upper or top portion 50, and a door means 52. The details of these elements of the expandable mail box 28 component of the yard marker 10 is described hereinafter. The expandable mail box 28 may be fabricated of any suitable material, such as, but not limited to, metal or plastics.

The lower portion 48 consists of a bottom member 54, two side members 56, and a back end member 58, all fabricated into an opened tray or box-like unit. The upper portion 50 telescopes over the lower portion 48 and consists of two side members 60 and a back end member 64 all fabricated together with rounded or semi-circular-like top 62. It is to be noted that the two side members 60 and the rounded top member 62 may be formed contiguously with each other. The overlap 66 in FIG. 6 indicates the telescoping of the upper portion 50 over the lower portion 48.

In a similar manner the door means 52, of the expandable mail box 28, also telescopes so that it may be adjusted to close the mail box 28 at whatever position it is expanded. The details regarding the telescoping mail box 28 and the door means 52 are provided hereinafter.

Figure 7:
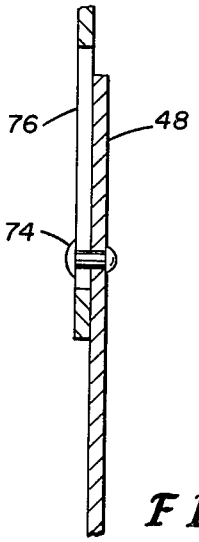
FIG. 7 is a partial cross-sectional view on line 7—7 of FIG. 5.

Essentially, the extent of the telescoping overlap 66 is governed by wide head stud means moving and confined in mating slot apertures. For the body or compartment element of the mail box 28, the control of the telescoping is provided by four studs 74 affixed to the lower portion 48 and four mating slot apertures 76 in the upper portion 50. The studs 74 are captive within the slots 76 and thereby limit the distance which the upper portion 50 may be raised vertically upward for expansion of the mail box 28. FIG. 7 shows the stud means 74 with a wide head, a shank portion under the wide head passing through the slot 76, a shoulder portion against the side of the lower portion 48 and the stud means 74 riveted or otherwise secured on the inside of the lower portion 48. The slotted aperture 76 is narrower than the wide head of the stud 74, but with sufficient clearance for the shank of the stud 74 to move freely in the up and down motion of the slotted aperture. These retaining means, the stud means 74 and the slotted apertures 76, are located one each near each end of each of the two sides 56 and 60 respectively.

Figure 8:
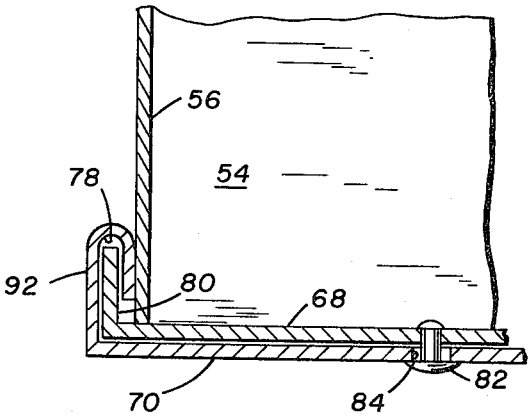
FIG. 8 is a partial cross-sectional view on line 8—8 of FIG. 3.

Turning now to the telescoping door means 52, FIG. 8 shows the details. In a manner similar to the aforementioned stud 74 and slotted aperture 76 for the lower and upper portions 48 and 50 respectively of the mail box 28, the door 52 is similarly structured. At least one stud means 82 is affixed to the lower portion 68 of the door means 52, and at least one slotted aperture 84 in the upper portion 70 of the door means 52. It is to be noted that it is within the scope and intent of the invention to provide a plurality of stud means 82 and mating slotted apertures 84 if desired or necessary by reason of the size of the door means 52.

The lower portion member 68 of the door means 52 has a perpendicular rib-like integrally continuation flange member 80 projecting on each side of the lower portion member 68, the door hinge (not shown) affixes the door means 52 to the bottom member 54. This rib-like flange member 80 provides for closing of the lower portion member 68 around the lower portion 48 of mail box 28 body.

The upper portion member 70 likewise has a perpendicular rib-like flange member 92 on each side and around and across the rounded top edge of 70. The distal end of the flange member 92, on each side only, but not across the top, is further extended in configuration and then bent in a 180° bend to form a groove means 78. The groove means 78 slideably moves vertically up and down the flange member 80 when the door means 52 is extended vertically to meet a vertical expansion of the mail box 28. Thus, the 180° bend of flange member 92 and the continuation of flange member 92 across the top completes the closing of the mail box 28.

The movement of the upper portion member 70 and the closing and opening of the door means 52 is accomplished by grasping the pull handle means 88 suitably affixed on the door. The expansion of the mail box 28 itself is accomplished by lifting the upper portion 50 vertically by grasping the lift handle means 72 suitably affixed to the top of the rounded top 62.

It is to be understood that although a rounded top 62 is shown on the mail box 28, that it is within the scope and intent of the invention to provide a top of other geometrical configuration with a door means to suit.

The resident identification 30 and the residence locator 32 (number only or full address) may be painted, made with decalcomanias, separate attached strips or by other suitable means.

It is to be noted that the base for the mail box can be designed so that the mail box can be reversed to receive mail deposited by the mailman either from the sidewalk or the street in order to save the mailman additional steps.

If desired, the door for the sand box area can be moved upwardly to obtain maximum storage space.

As can be readily understood from the foregoing description of the invention, the present structure can be configured in different modes to provide the ability to serve as a yard marker with a utility of functions, including the utility of an expandable mail box as a component thereof.

Accordingly, modifications and variations to which the invention is susceptible may be practiced without departing from the scope and intent of the appended claims.

What is claimed is:

1. A marker device, having a utility for providing a plurality of functions, comprising:

a structural frame means;

a receiving compartment portion, said receiving compartment portion being located within said structural frame means and suitably affixed thereto at the upper end thereof, said receiving compartment portion being for receiving newspapers and other items and being a first utility component;

a covering means, said covering means being suitably affixed to the exterior of said structural frame means so as to enclose said structural frame means and said receiving compartment portion, said covering means having a suitable first aperture therein to provide access to said receiving compartment portion;

at least one securing means, said securing means being suitably affixed to said structural frame means and extending therefrom to the exterior of said covering means, a suitable second aperture being provided in said covering means for each securing means provided so as to project therethrough, said securing means being for the purpose of securing objects thereto and being a second utility component;

an internal storage area, said internal storage area being structurally formed by the permanently affixed enclosing covering means on said structural frame means and located therewithin, said internal storage area having a floor member therein, said internal storage area having a suitable third aperture provided in said covering means for access thereto, said internal storage area being for the storage of articles and being a third utility component;

identification means, said identification means being applied and affixed in position on the exterior of said covering means, said identification means being a fourth utility component;

a support plate means, said support plate means being suitably affixed to the topmost surface of said structural frame means; and at least one expandable mail box means, said expandable mail box means being suitably affixed to said support plate means, said expandable mail box means being a fifth utility component.

2. The Marker device as recited in claim 1 and additionally, an anchoring means, said anchoring means being suitably affixed to the bottom portion of said structural frame means, said anchoring means extending downwardly from said structural frame means for suitable imbedment within the earth to provide stability for said marker device.

3. The marker device as recited in claim 1, wherein said securing means is hook-like, said hook-like configuration providing a means of affixing said objects thereto.

4. The marker device as recited in claim 1 and additionally, an access door means, said access door means being hingedly affixed to said covering means, said access door means being so located on said covering means so as to cover and close said third aperture in said covering means.

5. The marker device as recited in claim 4, wherein said hingedly affixed access door means is affixed with spring-loaded hinges.

6. The marker device as recited in claim 1, wherein said identification means consists of a resident's name and residence address locator suitably formed and affixed to said covering means.

7. The marker device as recited in claim 1, wherein said expandable mail box means consists of:

a lower body member;

an upper body member, said upper body member slidable telescoping over said lower body member; and a door member, said door member having a lower component and an upper component, said lower component being hingedly affixed to said lower body member and said upper component being slidably telescoped over said lower component.

8. The marker device as recited in claim 7, and additionally, a plurality of stud means and a plurality of slotted apertures, the shank of said study means being configured to slidably fit through said slotted apertures, said stud means having one end enlarged so as not to pass through said slotted aperture, at least two of said plurality of stud means being affixed to each side of said lower body member, at least two of said plurality of slotted apertures being located and configured in each side of said upper body member and to match and mate with said study means affixed to said lower body member, at least one of said plurality of stud means being affixed to said lower component of said door member, at least one of said plurality of slotted apertures being located and configured in said upper component of said door member, said combination of said stud means and respective associated slotted apertures providing the means for expanding said expandable mail box by moving said upper body member vertically and similarly moving said upper component of said door member vertically.

9. A marker device, having a utility for providing a plurality of functions, comprising:

a structral frame means;

receiving compartment portion, said receiving compartment portion being located within said structural frame means and suitably affixed thereto at the upper end thereof; said receiving compartment portion being for receiving newspapers and other items and being a first utility component;

a covering means, said covering means being suitably affixed to the exterior of said structural frame means so as to enclose said structural frame means and said receiving compartment portion, said covering means having a suitable first aperture therein to provide access to said receiving compartment portion;

at least one securing means, said securing means being suitably affixed to said structural frame means and extending therefrom to the exterior of said covering means, a suitable second aperture being provided in said covering means for each securing means provided so as to project therethrough, said securing means being for the purpose of securing objects thereto and being a second utility component;

an internal storage area, said internal storage area being structurally formed by the permanently affixed enclosing covering means on said structural frame means and located therewithin, said internal storage area having a floor member therein, said internal storage area having a suitable third aperture provided in said covering means for access thereto, said internal storage area being for the storage of articles and being a third utility component;

identification means, said identification means being applied and affixed in position on the exterior of said covering means, said identification means being a fourth utility component;

a support plate means, said support plate means being suitably affixed to the topmost surface of said structural frame means; and at least one expandable mailbox means, said expandable mailbox means being suitably affixed to said support plate means, said expandable mailbox means being a fifth utility component, said expandable mailbox means consisting of a lower body member, and upper body member, said upper body member slidably telescoping over said lower body member, a door member, said door member having a lower component and an upper component, said lower component being hingedly affixed to said lower body member and said upper component being slidably telescoped over said lower component, a plurality of stud means, a plurality of slotted apertures, the shank of said stud means being configured to slidably fit through said slotted apertures, said stud means having one end enlarged so as not to pass through said slotted aperture, at least two of said plurality of stud means being affixed to each side of said lower body member, at least two of said plurality of slotted apertures being located and configured in each side of said upper body member and to match and mate with said stud means affixed to said lower body member, at least one of said plurality of stud means being affixed to said lower component of said door member, at least one of said plurality of slotted apertures being located and configured in said upper component of said door member, said combination of said stud means and respective associated slotted apertures providing the means for expanding said expandable mailbox by moving said upper body member vertically and similarly moving said upper component of said door member vertically, a handle means, said handle means being suitably affixed to the upper exterior surface of said upper body member, said handle means providing a means for grasping and raising said upper body member vertically upward, and a pull means, said pull means being suitably affixed to said upper component of said door member, said pull means providing a projection for grasping to open, close, and vertically move said door member.

* * * * *